US006443640B1

(12) United States Patent
Earle et al.

(10) Patent No.: US 6,443,640 B1
(45) Date of Patent: Sep. 3, 2002

(54) PROCESSING PHOTOGRAPHIC MATERIAL

(75) Inventors: Anthony Earle, Harrow Weald; Nigel R. Wildman, Watford Hertfordshire, both of (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/961,496

(22) Filed: Sep. 24, 2001

(51) Int. Cl.[7] ..... G03D 13/00

(52) U.S. Cl. ..... 396/571; 396/578; 396/612; 396/626; 355/27; 355/41

(58) Field of Search ..... 396/571, 578, 396/626, 612; 355/27–29, 38, 40, 41; 358/487

(56) References Cited

U.S. PATENT DOCUMENTS 3,680,463 A * 8/1972 Attridge et al. ..... 396/569
4,240,737 A * 12/1980 Lawson ..... 118/666
4,985,720 A 1/1991 Masuda et al. ..... 396/571
5,578,431 A * 11/1996 Fyson ..... 396/568
5,809,362 A 9/1998 Tsuji ..... 396/571
5,845,169 A * 12/1998 Patton et al. ..... 396/564
6,222,607 B1 * 4/2001 Szajewski et al. ..... 396/578

FOREIGN PATENT DOCUMENTS

EP 446769 9/1991
EP 694815 1/1996

* cited by examiner

*Primary Examiner*—D Rutledge
(74) *Attorney, Agent, or Firm*—Frank Pincelli

(57) ABSTRACT

Photosensitive material is processed by passing the material through a chamber holding processing solution, the temperature of the solution being raised as the material passes through the chamber.

5 Claims, 6 Drawing Sheets

ROYAL GOLD 400
DEVELOPER A AND A* (DASHED) 30 SECONDS @55C

ROYAL GOLD 400
DEVELOPER A AND A* (DASHED) 30 SECONDS @55C (57.5C DASHED)

PROCESSING PHOTOGRAPHIC MATERIAL

FIELD OF THE INVENTION

This invention relates to a method of processing photographic material. In particular the invention relates to a method of processing which uses a low volume of processing solution and which provides images of non-varying quality.

BACKGROUND OF THE INVENTION

The processing of photosensitive material such as photographic film involves a series of steps such as developing, bleaching, fixing, washing and drying. In this process a continuous web of film or cut sheet of film is sequentially conveyed through a series of stations or tanks, with each one containing a different processing solution appropriate to the process step at that stage.

When using small volumes to process a film the chemicals slowly exhaust themselves and lose activity. This can lead to unacceptable processing variations along the length of the film. It is important to maintain the activity of the process to give repeatable results and match manufacturer's specifications.

To achieve repeatable results for the C41 process the temperature must be held constant to +0.15° C. and fresh chemistry must be added to the bath or tank to maintain steady chemical activity.

Work has been done on this in the past. EP 694,815 shows that temperature can be used to compensate for the activity loss during colour paper processing but in this instance to yield a fixed sensitometric result. The availability of digital image processing allows the image to be corrected from what otherwise would be a uncorrectable image in a optical print system if information is known about the current state of the process.

With the advent of digital scanning lower image contrast can be tolerated and this has led to the use of smaller volumes of chemistry in the tanks and the reduction of process times. New processing methods using single shot and batch non-replenished systems have led to the use of volumes that are at or approaching the manufactures typical replenishment volumes (4–6 ml/ft).

However, without the benefit of the large volumes held in conventional processors smoothing sensitometric changes, unacceptable results are obtained even with scanning. This can be seen in FIG. 2 of the accompanying drawings. It is an aim of the invention to provide a method of processing which gives acceptable results with very low volumes of processing solution.

SUMMARY OF THE INVENTION

According to the present invention there is provided a method of processing photosensitive material comprising passing the material through at least one processing chamber containing processing solution, the volume of the solution being less than 1000 ml, and raising the temperature of the solution as the material passes through the chamber, the rate of temperature increase being determined by the rate at which the material passes through the solution.

Preferably the volume of the processing solution is less than 500 ml.

The method of the invention ensures that acceptable images can be obtained from the entire length of the film. Digital image processing time may be reduced by using the invention.

Lower volumes of processing solutions are used which leads to cost reductions.

The invention is easily applied to standard processing apparatus

BRIEF DESCRIPTION OF THE DRAWINGS

The invention will now be described, by way of example only, with reference to the accompanying drawings in which.

DETAILED DESCRIPTION OF THE INVENTION

Figure 1:
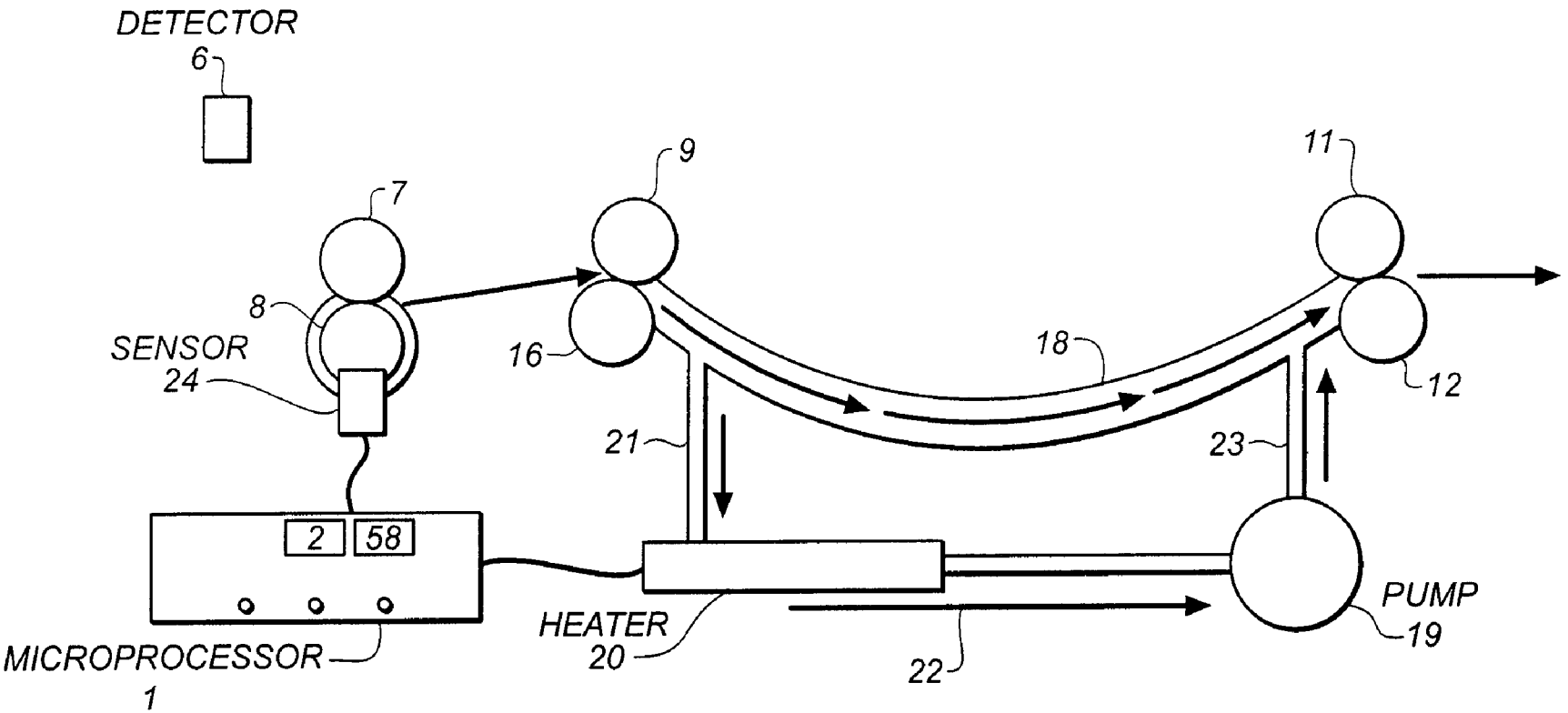
FIG. 1 is a sketch of an apparatus which may be used to perform the method of the invention.
Figure 2:
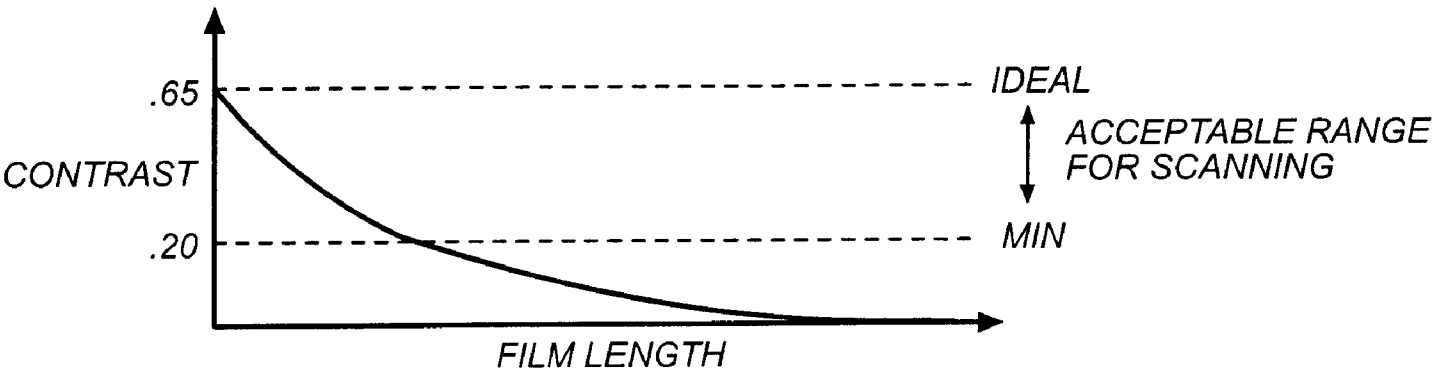
FIG. 2 is a graph showing how contrast changes with length of film using conventional methods of processing.

FIG. 1 shows the outline of an apparatus which may be used to perform the invention.

FIG. 1 shows a narrow processing channel 18 through which material to be processed passes. A pair of rollers 9 and 16 are provided at the inlet to the channel. A pair of rollers 11 and 12 are provided at the exit of the channel 18. Two passages 21 and 23 connect the channel 18 to a circulation system. The system includes a pump 19 and a heater 20. In the embodiment shown the solution heater 20 is situated in the circulation system loop before the pump 19, in the direction of flow. Prior to the processing channel there is provided a detector 6 and a pair of rollers 7 and 8. Located on the roller 8 is a sensor 24. The sensor 24 is in connection with a micro processor 1.

In operation film is fed in the direction of the arrow shown in FIG. 1. The presence of the film is detected by detector 6. When film is detected the pump 19 and the heater 20 are switched on. The heater 20 increases the temperature of the processing solution by a predetermined amount. The temperature rise is predetermined by parameters set in the microprocessor 1, such as the transport speed of the apparatus and the starting temperature of the processing solution. The temperature of the processing solution may be varied either along the length of a film as it passes through the apparatus and/or from one film to the next. These two modes of temperature rise are set by a switch on the microprocessor.

When the heater 20 has heated the solution by the predetermined amount the drive rollers 7, 8, 9, 10, 11 and 12 start to rotate and drive the film through the processor. The film passes through the channel 18 in the direction shown by the arrows. The channel contains the solution for processing the film.

Agitation of the solution is provided by the circulation pump 19. The flow of processing solution through the system can be seen by the arrows. It will be appreciated that the apparatus is charged with a small amount of solution when the film is detected by the detector 6 and that the volume of the solution and its chemical constituents are not sufficient to satisfactorily process the film along its whole length. To over come this the sensor 24 measures the length of film that has passed into the processor. The sensor sends its output to the micro-processor 1 which sends a signal to raise the temperature of the heater 20. This in turn increases the solution temperature and raises the chemical activity of the solution. The rate of the temperature rise is determined by a predetermined algorithm thus ensuring that the film will produce acceptable pictures along its whole length.

In one embodiment the chemistry would be fresh at the start of each film and then discarded once used. In another embodiment the same set up could be used to run a batch system whereby the chemistry is returned to the bulk reservoir after each use. In this instance the film would be processed in sufficient solution to ensure no difference in processing along its whole length. The drop in chemical activity which would be seen from film to film in apparatus of the prior art would be compensated for in this case by progressively increasing the temperature of the solution.

As explained above, the temperature of the processing solutions may be either varied along the length of a film as it passes through the apparatus or from one film to the next.

Figure 3:
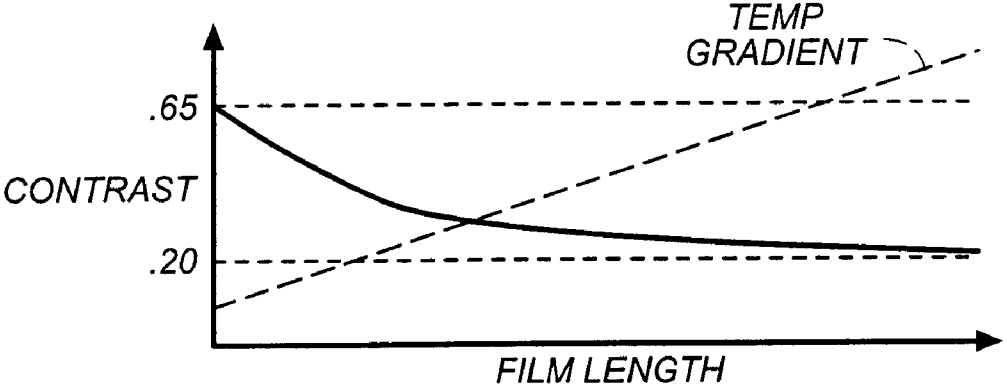
FIG. 3 is a graph showing how contrast changes with length of film using the method of the invention.

As the volumes of processing solutions used are very low it is possible to accurately heat the solutions to a given temperature ramp rate over the length of the film as it passes through the process. It is known that raising the temperature of the solution will increase the activity of the process. Therefore, by determining the rate of temperature rise required, close to constant sensitometric output can be achieved. The results are certainly within acceptable limits for image quality. FIG. 3 illustrates this effect. It is desired that the contrast slope achieved by the method of the invention should not fall below 0.2.

The example below shows that temperature is a viable way of increasing the developer activity and hence the densities obtained from a scanned film in order that the said densities are maintained above a certain minimal threshold below which good image scans cannot be obtained. In all cases the developer film combination is not able to produce an optically printable negative original. However, increasing the temperature allows more film to be processed per unit volume of developer solution without the densities falling below the minimum required to produce an reasonable image.

Example

Kodak Royal Gold 400 film was exposed to a 21 step tablet for $1/100^{th}$ second with a daylight (6500 K) colour correction filter. The film was processed in 1.3 liters of developer A, Kodak Flexicolor C41RA bleach, and Kodak Flexicolor fixer and replenisher.

The process times and temperatures were as shown in Table 1.

TABLE 1

| | | |
|---|---|---|
| Developer A | 30 seconds | 55° C. |
| Kodak Flexicolor C41RA bleach | 60 seconds | 55° C. |
| Kodak Flexicolor fixer and replenisher | 120 seconds | 55° C. |
| Wash | 60 seconds | 40° C. |

Kodak Flexicolor C41RA bleach, and Kodak Flexicolor fixer and replenisher are commercially available, developer A is made using the formula below.

| Developer A | |
|---|---|
| Antical 8 (DTPA solid) | 2.6 g/L |
| KI | 0.02 g/L |
| NaBr | 2.8 g/L |
| $Na_2SO_3$ (anhydrous) | 10.53 g/L |
| Hydroxylamine sulphate | 3 g/L |
| Polyvinylporolidone K 15 | 3 g/L |
| $K_2CO_3$ | 40 g/L |
| CD4 | 15 g/L |
| pH | 10.48 |

Figure 4:
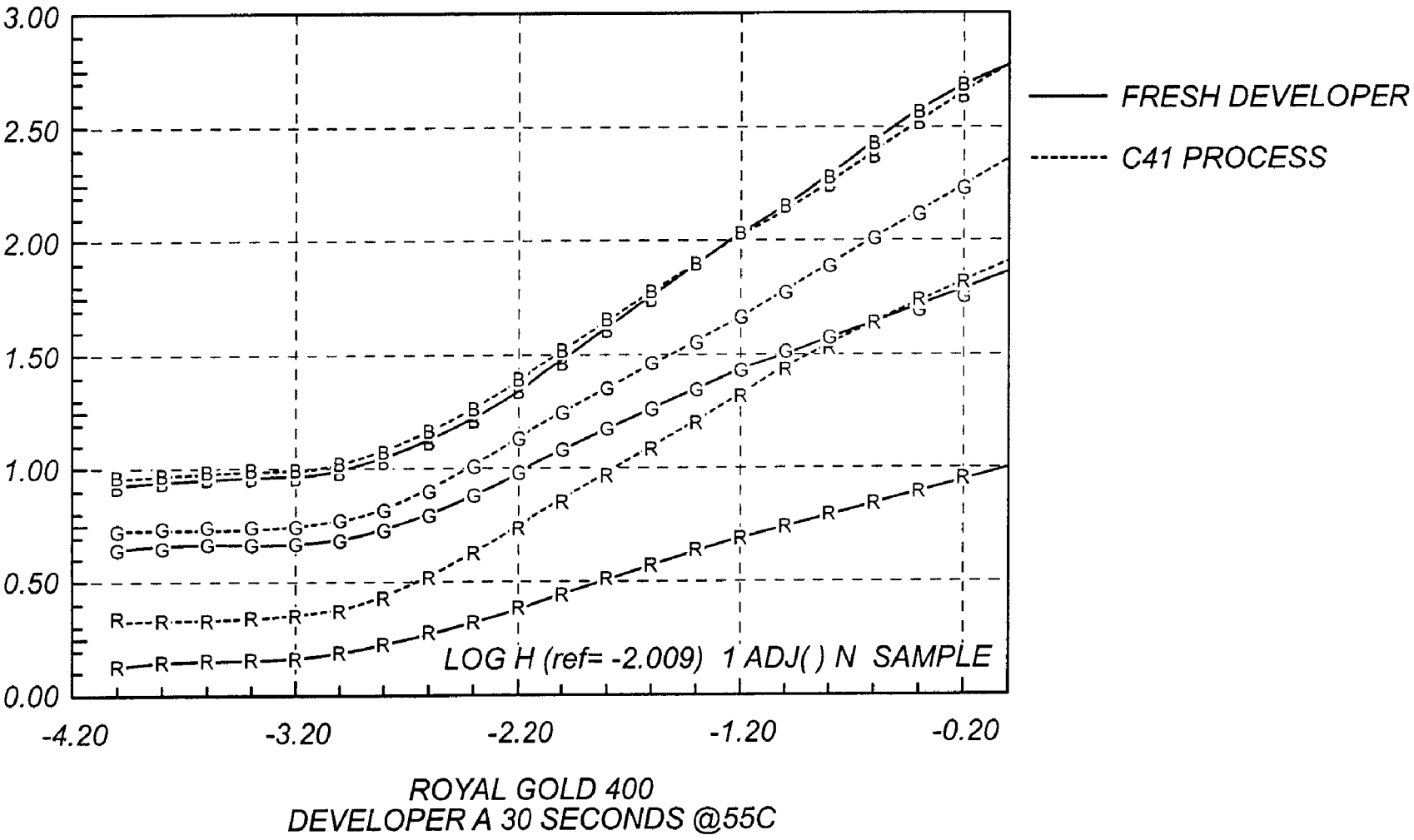
FIGS. 4 to 7 are graphs illustrating the results of the example described below.

The above film was processed in Developer A for the above conditions and resulted in the sensitometric response shown in FIG. 4. This sensitometry is not ideal for the optical printing of the negative onto colour photographic paper. The result for the Kodak C41 process can be seen as the dashed line. This process provides negatives that can be optically printed onto colour photographic paper.

The effect of processing 100 rolls of 24 exposure 135 film was modeled using a 1 liter developer batch size, knowing the film's chemical usage rates. No replenishment was added to the batch during this time. Therefore the chemicals in the developer were consumed and seasoning products released. From the model the composition of the tank after the $100^{th}$ roll of film processed was deduced. This developer is called Developer A* and is shown below.

| Developer A* | |
|---|---|
| Antical 8 (DTPA solid) | 2.6 g/L |
| KI | 0.02 g/L |
| NaBr | 3.8 g/L |
| $Na_2SO_3$ (anhydrous) | 10.53 g/L |
| Hydroxylamine sulphate | 3 g/L |
| Polyvinylporolidone K 15 | 3 g/L |
| $K_2CO_3$ | 40 g/L |
| CD4 | 12.5 g/L |
| pH | 10.40 |

Figure 5:
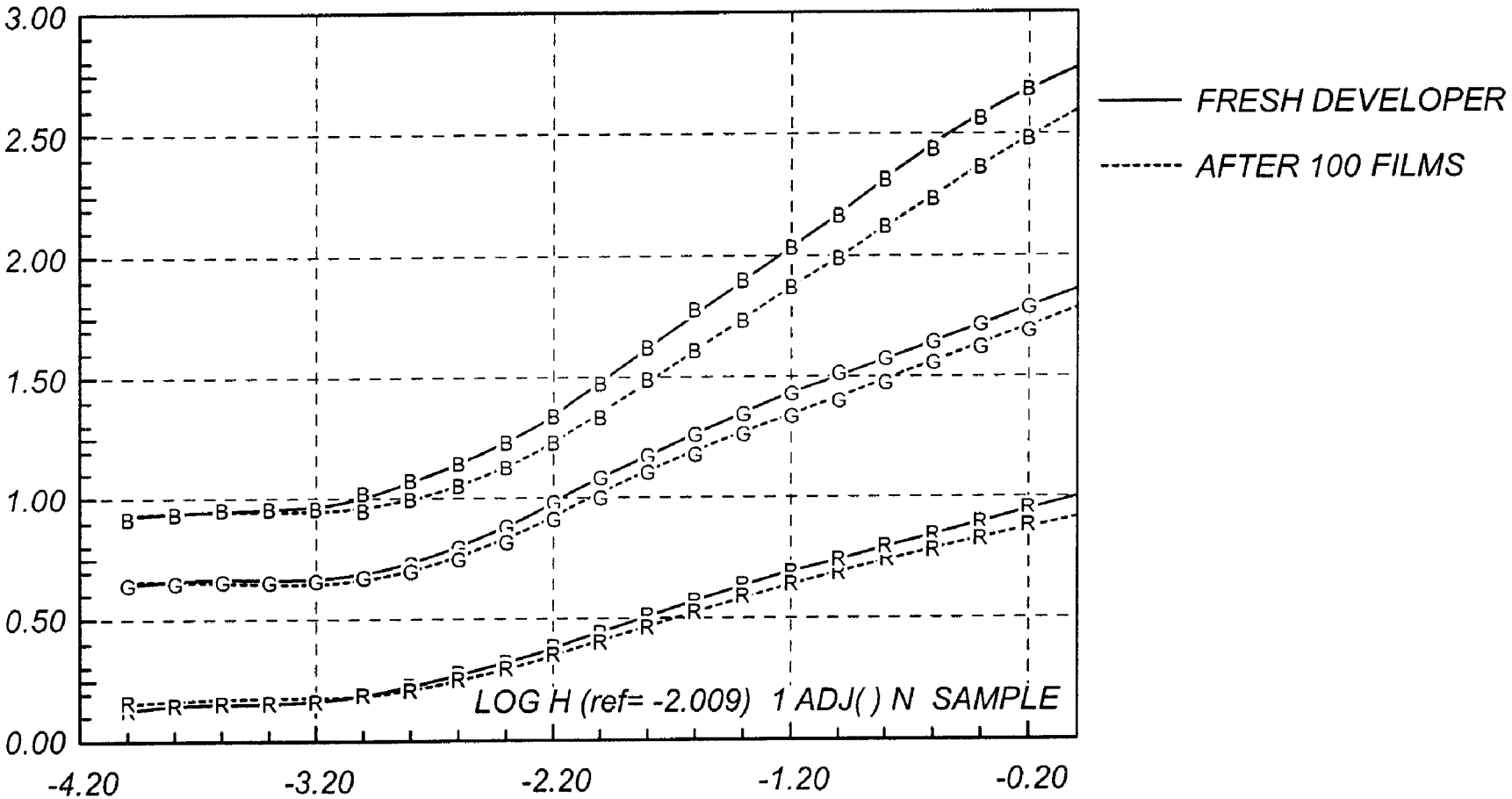

The above developer was made and Royal Gold 400 film was processed as described above. The sensitometry relative to the fresh starting developer can be seen in FIG. 5. Speed and contrast changes are seen which if the film was continued to be processed would fall below that which can be digitally corrected by algorithms. At this point, the number of films processed represents the maximum capacity of the developer for obtaining an adequate image.

The number of films which can be processed can be enhanced by the invention by increasing the temperature to compensate for the sensitometric density loss. Depending on the sensitometric density loss per unit area of film processed, a temperature can be selected that returns the sensitometry above the minimum required D log E curve required to produce a digitally corrected image.

Figure 6:
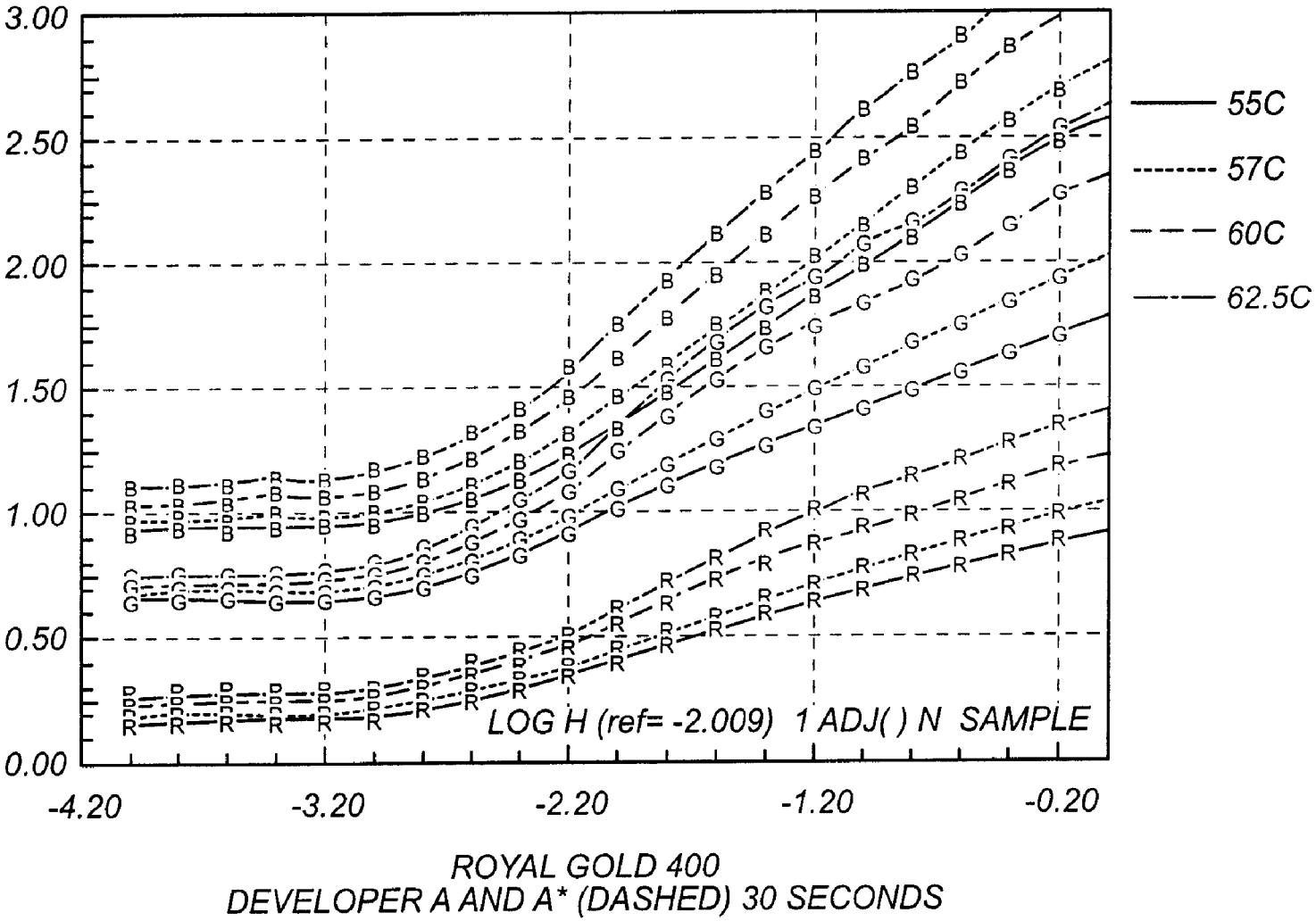

The temperature sensitivity of the solution can be seen in FIG. 6.

It is apparent that there is ample activity to be gained by increasing the temperature. Hence the number of films processed per unit volume of developer can be increased substantially as the sensitometry does not have to be ideal (for optical printing) or identical to the starting point as long as the change in sensitometry with the film area and temperature rise is well known. Algorithms can then be used to restore the image to the ideal tone scale and colour.

Figure 7:
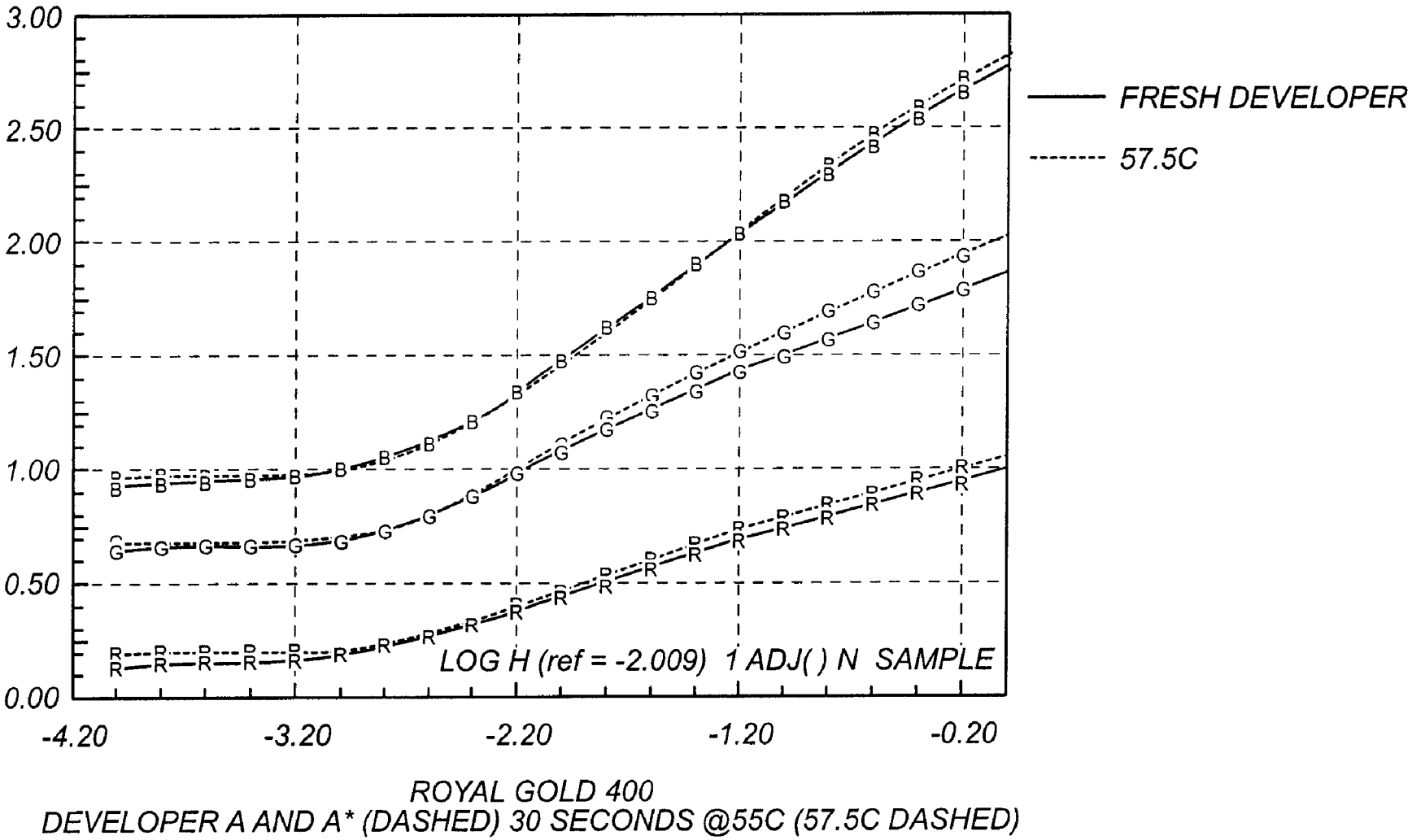

The example shows that the sensitometric response relative to the Developer A starting position can be preserved in the desired range for digitally correctable images of good quality, as shown in FIG. 7.

By increasing the temperature as the film passes through the process the activity of the chemicals can be boosted ensuring that the variability along the length of the film is reduced to acceptable limits. In a similar fashion when drawing from an unreplenished ballast or batch system the tank process could be performed at a constant temperature per length but that temperature could be raised film to film as the ballast becomes exhausted. This would also help maintain sensitometric performance from film to film as the chemistry exhausts itself.

The invention is applicable to developer, bleach, fix or bleach/fix solutions.

The invention has been described in detail with reference to a preferred embodiment thereof. It will be understood by those skilled in the art that variations and modifications can be effected within the spirit and scope of the invention.

PARTS LIST

1 microprocessor
6 detector
7 pair of rollers
8 pair of rollers
9 pair of rollers
10 roller
11 pair of rollers
12 pair of rollers
16 pair of rollers
18 channel
19 pump
20 heater
21 passage
22 passage
24 sensor

What is claimed is:

1. A method of processing photosensitive film comprising passing the film through at least one processing chamber containing processing solution, the volume of processing solution being less than 1000 ml. and raising the temperature of the solution as the film passes through the chamber, the rate of temperature increase being determined by the rate at which the film passes through the chamber, images on the film being digitally scanned after the film leaves the chamber and digitally reconstructed using knowledge of the effect of the temperature upon the sensitometric response of the film.

2. A method as claimed in claim 1 wherein the volume of the processing solution is less than 500 ml.

3. A method as claimed in claim 1 wherein the volume of the processing solution is less than 300 ml.

4. A method as claimed in claim 1 wherein the temperature of the solution is raised as one film passes through the processing chamber.

5. A method as claimed in claim 1 wherein the temperature of the solution is raised from film to film as a batch of films pass through the processing chamber.

* * * * *

UNITED STATES PATENT AND TRADEMARK OFFICE

CERTIFICATE OF CORRECTION

PATENT NO. : 6,443,640 B1
DATED : September 3, 2002
INVENTOR(S) : Anthony Earle et al.

It is certified that error appears in the above-identified patent and that said Letters Patent is hereby corrected as shown below:

Title page,
Insert: -- [30] Foreign Application Priority Data
November 3, 2000 (GB) ……. 0026953.0 --

Signed and Sealed this

Twenty-seventh Day of May, 2003

JAMES E. ROGAN
*Director of the United States Patent and Trademark Office*